US008113649B2

(12) United States Patent
Hagiwara

(10) Patent No.: US 8,113,649 B2
(45) Date of Patent: Feb. 14, 2012

(54) TRANSFER APPARATUS, METHOD FOR PREVENTING LEAKAGE CURRENT OF THE TRANSFER APPARATUS, AND IMAGE FORMING APPARATUS INCLUDING THE TRANSFER APPARATUS

(75) Inventor: Takumi Hagiwara, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 432 days.

(21) Appl. No.: 12/417,807

(22) Filed: Apr. 3, 2009

(65) Prior Publication Data

US 2009/0262173 A1 Oct. 22, 2009

(30) Foreign Application Priority Data

Apr. 18, 2008 (JP) ..... 2008-109514
Feb. 27, 2009 (JP) ..... 2009-046561

(51) Int. Cl.
*B41J 2/01* (2006.01)

(52) U.S. Cl. ..... 347/107

(58) Field of Classification Search ..... None
See application file for complete search history.

(56) References Cited

U.S. PATENT DOCUMENTS 6,249,305 B1 * 6/2001 Miyamoto et al. ..... 347/232
7,036,905 B2 * 5/2006 Nagai et al. ..... 347/22
2004/0041897 A1 * 3/2004 Chino et al. ..... 347/153

FOREIGN PATENT DOCUMENTS

JP 60-076759 5/1985
JP 07-053082 2/1995
JP 2006-016111 1/2006

* cited by examiner

*Primary Examiner* — Stephen Meier
*Assistant Examiner* — Alexander C Witkowski
(74) *Attorney, Agent, or Firm* — IPUSA, PLLC

(57) ABSTRACT

A disclosed transfer apparatus includes an endless belt to transfer a recording member by attaching the recording member on a surface thereof by an electrostatic force; a driving device to rotate the endless belt; and a holding device to temporarily hold the recording member to hinder a movement thereof caused by a movement of the endless belt rotated by the driving device so that a part of the recording member slides on the surface of the endless belt.

16 Claims, 10 Drawing Sheets

TRANSFER APPARATUS, METHOD FOR PREVENTING LEAKAGE CURRENT OF THE TRANSFER APPARATUS, AND IMAGE FORMING APPARATUS INCLUDING THE TRANSFER APPARATUS

BACKGROUND OF THE INVENTION

1. Field of the Invention

The present invention generally relates to a transfer apparatus, a method for preventing a leakage current of the transfer apparatus, and an image forming apparatus including the transfer apparatus.

2. Description of the Related Art

In inkjet type image forming apparatuses (inkjet printers), images are formed by discharging ink onto recording paper that is moved on a paper transfer apparatus. When the recording paper is too thin or too much ink is discharged onto the recording paper, the ink impregnates the fibers of the recording paper. The fibers swollen by the ink causes the recording paper to be bent in a wrinkled state (the wrinkled state is referred to as "cockling"), and may cause the recording paper to be lifted. When the recording paper is lifted, landing positions of the discharged ink droplets are displaced from the predetermined positions or the recording paper contacts a recording head, resulting in drastically decreasing the quality of an image formed on the recording paper.

In order to prevent the recording paper from being lifted, various ways have been suggested such as using thick recording paper which is not swollen even when impregnated by the ink, using expensive paper coated with an ink absorbent which prevents impregnation of ink into a surface of the recording paper, drying the recording paper by hot air before the recording paper is swollen, forcibly drying the recording paper by heating a back side of the recording paper with a heater, or providing a guiding plate for preventing the recording paper from being lifted. However, these ways have disadvantages of leading to an increase in printing cost.

In view of this, an electrostatic attaching type paper transfer apparatus has been suggested to be applied, of which usage has been proven in a page turner or a paper transfer apparatus in an electrophotographic type image forming apparatus. In this paper transfer apparatus, a high voltage is applied to a transfer belt to generate an electrostatic force so that recording paper is forcibly attached onto the transfer belt, whereby the swollen recording paper is prevented from being lifted (for example, see Patent Document 1). According to this paper transfer apparatus, paper can be prevented from being lifted due to swelling without using a complicated mechanism, and images can be formed on the paper with high printing quality by hardly increasing the printing cost.

However, when an inkjet printer and the like sufficiently cooled over night in winter are exposed to warm air emitted from a heating appliance such as an air conditioner, a gas heater, and an oil heater in the morning, condensation may form on the surface of the transfer belt since the transfer belt at a low temperature is exposed to the warm and humid air. The condensation on the surface of the transfer belt leads to a leakage current generated when a high voltage is applied to the transfer belt. Normally, when a leakage current is generated in a high voltage power source system, the power of the apparatus is turned off in view of protecting the apparatus and ensuring safety. When a leakage current that is not significant enough to cause the apparatus to be turned off is generated, a control board is normally started and made ready to be used when the power of the apparatus is turned on. However, when an instruction to start printing is received and a high voltage power source board is turned on, a leakage current flows through the condensation on the surface of the transfer belt. A leakage detecting circuit provided in the high voltage power source detects this abnormality and registers an error. Such a phenomenon can be caused every morning in a specific period for a user in a cold region.

In view of this, a simple countermeasure to obtain reliable effect against such a phenomenon is in demand. For example, there is a known method to incorporate a condensation preventing heater, which has been employed in expensive electrophotographic type printers and the like. However, this method has defects in that manufacturing cost is increased so that inexpensive types of printers cannot easily employ this method, current is consumed when the power is off, and the condensation preventing heater does not work when the main power of the apparatus is off.

As a countermeasure for this method, Patent Document 2 discloses a method for preventing a current leaking from a transfer belt, from another point of view. In this method for preventing a leakage current, in the case where the image forming apparatus registers an error because of a leakage current caused due to condensation on the transfer belt when the apparatus is not operating, a high voltage power source is turned off and recording paper is transferred to the transfer belt so that the condensation (moisture) on the transfer belt is absorbed by the recording paper. Normally, plural sheets of recording paper are supplied onto the transfer belt and then transferred in an idle manner without undergoing image printing. This operation is repeated until the condensation all over the transfer belt is absorbed. As a result, the current leaking from the transfer belt is resolved. When the leakage current flowing from the transfer belt is resolved, a high voltage is applied to the transfer belt again, and a normal image forming operation can be performed.

According to the method for preventing a leakage current disclosed in Patent Document 2, a leakage current caused by condensation on the transfer belt can be prevented without significantly increasing the manufacturing cost and power consumption of the image forming apparatus. However, this method requires plural sheets of recording paper to absorb the condensation. In particular, in order to absorb the condensation all over the transfer belt, the plural sheets of recording paper are transferred in an idle manner until the whole surface of the transfer belt is contacted by the recording paper. In the case where the standard-sized paper sheets are used, there is an interval set between the transfers of the sheets of paper. Therefore, in order to transfer the recording paper to contact the interval part of the transfer belt, the transfer belt has to rotate plural times. In this case, many sheets of recording paper are wasted and a longer time is required.

Patent Document 1: Japanese Patent Application Publication No. 7-53082

Patent Document 2: Japanese Patent Application Publication No. 2006-16111

SUMMARY OF THE INVENTION

In view of the above-described problems, it is an object of at least one embodiment of the present invention to provide a transfer apparatus, a method for preventing a leakage current of the transfer apparatus, and an image forming apparatus including the transfer apparatus, by which recording papers wasted for absorbing condensation are drastically reduced, and a leakage current caused by condensation on the transfer belt is resolved without significantly increasing the manufacturing cost and power consumption.

According to one aspect of the present invention, a transfer apparatus includes an endless belt to transfer a recording member by attaching the recording member on a surface thereof by an electrostatic force; a driving device to rotate the endless belt; and a holding device to temporarily hold the recording member to hinder a movement thereof caused by a movement of the endless belt rotated by the driving device so that a part of the recording member slides on the surface of the endless belt.

According to another aspect of the present invention, a method for preventing a leakage current of a transfer apparatus is provided. The transfer apparatus includes an endless belt to transfer a recording member by attaching the recording member on a surface thereof by an electrostatic force; and a driving device to rotate the endless belt. The method includes the steps of holding the recording member by a holding device to hinder a movement of the recording member caused by a movement of the endless belt rotated by the driving device such that a part of the recording member contacts the surface of the endless belt; rotating the endless belt by the driving device so that the part of the recording member slides on the surface of the endless belt; and releasing the recording member to be transferred out of the endless belt.

DETAILED DESCRIPTION OF THE PREFERRED EMBODIMENTS

Figure 1:
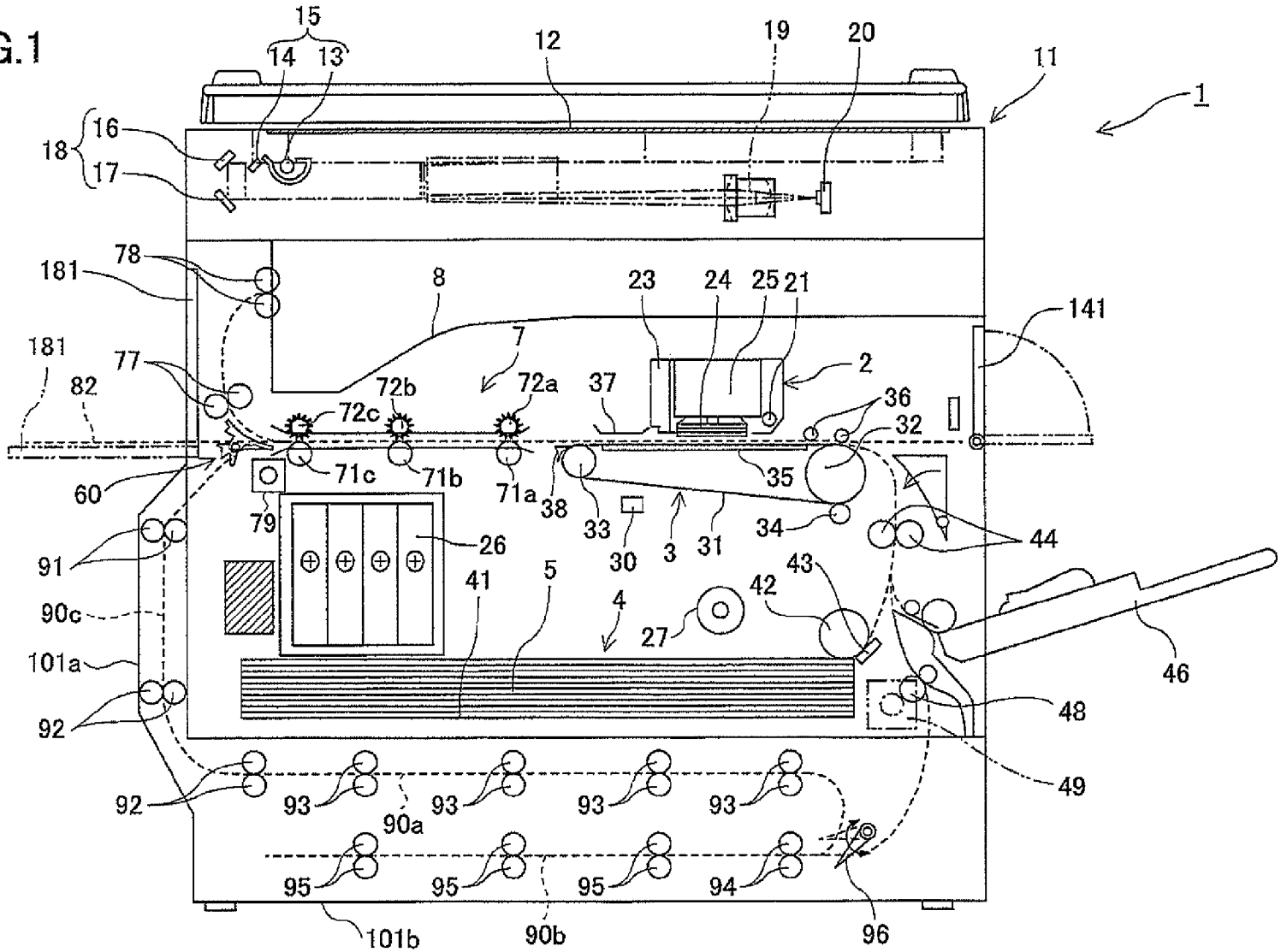
FIG. 1 is a schematic diagram of an image forming apparatus.

An embodiment of the present invention is described in detail below.

The present invention relates to a transfer apparatus used in an image forming apparatus and the like, to transfer a recording member and the like by attaching the recording member on an endless belt by applying a voltage onto a surface of the endless belt. A transfer apparatus of the embodiment of the present invention includes a driving device to stretch and rotate the endless belt; a power source to apply the voltage to the endless belt; a holding device to hold a moisture absorbing member at a predetermined position with a part or all of the moisture absorbing member contacting the surface of the endless belt; and a rotation amount measuring device to measure an amount of a rotation of the endless belt.

The endless belt is stretched by at least two rollers and the like. One of the two rollers, which serves as a driving roller, rotates the endless belt. Recording paper serving as the recording member is transferred onto this rotating endless belt, and ink is discharged from an ink discharging nozzle onto the recording paper in synchronization with a transfer position of the recording paper, to form an image on the recording paper. In that case, a voltage is applied to the endless belt from a power source which generates a high voltage, so that the recording paper is attached onto the endless belt by electrostatic force. Accordingly, a whole surface of the recording paper is attached on the endless belt. Thus, even when the recording paper is swollen by discharged ink, a part of the recording paper is neither peeled off from the endless belt nor is it wrinkled.

A transfer apparatus of a preferred embodiment of the present invention includes a current detecting device to detect a leakage current leaking from the endless belt. The current detecting device detects the abnormal leakage current before the leakage current from the endless belt causes an abnormality in a control device and the like or a possibility of electric shock. In addition, the current detecting device can also detect whether the endless belt is normally charged and the charge is functioning.

When starting an operation of an image forming apparatus and the like including the transfer apparatus of the present invention, condensation may be formed on the transfer belt of the transfer apparatus depending on the environmental conditions before starting the operation. In the case where the transfer apparatus does not include the current detecting device, the following operations are performed when starting the operation of the transfer apparatus of the invention. A voltage is applied to the transfer belt, the transfer belt is rotated before transferring the recording member (hereinafter, rotation of the transfer belt where the recording member is not being transferred is called "idle rotation"), and a moisture absorbing member is arranged and held at a predetermined position on the endless belt by the holding member. The idle rotation may be performed depending on detected environmental conditions such as temperature and humidity around the transfer apparatus, or every time the operation of the transfer apparatus is started.

In the case where the transfer apparatus includes the current detecting device, a voltage is applied to the transfer belt, and a leakage current is detected by the current detecting device at the same time as rotating the transfer belt in an idle manner before transferring the recording member. When the leakage current is at a predetermined value or lower, it can be determined that there is no condensation on the transfer belt and the recording paper can be normally transferred. Therefore, the operation can be started right away. When the leakage current is greater than the predetermined value, it is determined that there is condensation on the transfer belt and the recording paper cannot be normally transferred.

In the case where the leakage current is greater than the predetermined value, the moisture absorbing member is arranged and held at a predetermined position on the endless belt by the holding device. The moisture absorbing member is preferably a sheet having a moisture absorbing property, which is similar to the recording member. The moisture absorbing member preferably has approximately the same width as the endless belt. Further, it is preferable that the moisture absorbing member have enough strength not to be easily torn even when the moisture absorbing member slides on the endless belt. Normally, recording paper may be used as the moisture absorbing member.

When the endless belt is rotated with a part or all of the absorbing member being in contact with the surface of the endless belt, the moisture absorbing member and the surface of the endless belt slide while contacting each other since the moisture absorbing member is held by the holding device. At this time, it is preferable that a position of the moisture absorbing member corresponding to an upstream side of a rotation direction of the endless belt be held by the holding device. As a result, the moisture absorbing member continues contacting the surface of the endless belt without being loosened or bent. When the endless belt rotates once, the whole surface of the endless belt contacts the moisture absorbing member. Therefore, the condensation on the surface of the endless belt is absorbed into one sheet of recording paper serving as the moisture absorbing member. Thus, an abnormal leakage current flowing from the endless belt due to the condensation is eliminated and the transfer apparatus can be normally operated. Note that the endless belt may be rotated in the same direction as that in a normal operation of the transfer apparatus; however, the endless belt can also be rotated in a reverse direction. When the endless belt is rotated in the reverse direction, recording paper is held on a paper output side of the endless belt.

Further, in the case where condensation on the endless belt is not sufficiently absorbed (insufficient absorption of moisture) while the endless belt is rotated once due to a sliding abnormality and the like caused between the endless belt and the moisture absorbing member, the condensation may be completely removed by further rotating the endless belt. When the insufficient absorption of moisture is caused by saturation of the moisture absorbing member, the contact position of the moisture absorbing member with respect to the endless belt may be changed or the moisture absorbing member may be replaced to repeat the sliding operations of the endless belt and the moisture absorbing member. Note that the abnormal leakage current caused by the condensation may be detected by the current detecting device.

In many cases, the same recording paper as the recording member is used as the moisture absorbing member. Thus, the moisture absorbing member which has absorbed moisture has an increased sliding friction force applied and is decreased in strength. In other words, the moisture absorbing member becomes fragile with the absorption of moisture. Considering such a problem, it is preferable to provide a torque detecting device in the driving device of the transfer belt and the like in order to release the holding of the moisture absorbing member and output the moisture absorbing member from the transfer apparatus when a predetermined torque generated in the driving device of the transfer belt is detected.

An embodiment of the present invention is described in specific terms with reference to the drawings.

(Image Forming Apparatus)

A transfer apparatus of the present invention is often incorporated in an image forming apparatus and the like. First, an embodiment of an image forming apparatus including the transfer apparatus of the present invention is described. FIG. 1 is a schematic diagram showing the embodiment of the image forming apparatus of the present invention. The image forming apparatus of this embodiment is a copying apparatus including an inkjet type image forming apparatus. An apparatus body 1 (housing) includes an image forming part (unit) 2 to form an image, a sub-scanning transfer part (unit) 3, and the like. Recording members 5 (hereinafter referred to as "paper", but their material is not limited to paper) serving as transferred members are picked up and fed one by one from a paper feed part (unit) 4 provided at a bottom part of the apparatus body 1. While the fed paper 5 is intermittently transferred by the sub-scanning transfer part 3 to a position facing the image forming part 2, liquid droplets are discharged onto the paper 5 by the image forming part 2 to form (record) a desired image. Then, the paper 5 is output via a paper output transfer part 7 to a paper output tray 8 provided as an upper surface of the apparatus body 1.

This image forming apparatus which is assumed to be a copying apparatus includes, as an input system of image data (print data) used by the image forming part 2, an image reading part (scanner part) 11 to read an image, in an upper part of the apparatus body 1 above the paper output tray 8. This image reading part 11 has a scanning optical system 15 including a lighting source 13 and a mirror 14; and a scanning optical system 18 including mirrors 16 and 17. The scanning optical systems 15 and 18 move to read an image of a document placed on a contact glass 12. The scanned image of the document is read as image signals by an image reading element 20 arranged on a rear side of a lens 19. The read image signals are digitized and processed into the print data which can be printed. Note that a pressing board for pressing the document is provided on the contact glass 12.

Further, as for the input system of the image data (print data) used by the image forming part 2, this image forming apparatus can receive printing data and the like including image data from a host side, such as an information processing apparatus like an external personal computer, an image reading apparatus like an image scanner, and an imaging device like a digital camera via a cable or a network. The received print data can be processed and printed by the image forming apparatus.

Here, the image forming part 2 of this image forming apparatus holds a carriage 23 by a carriage guide 21 and a guide stay which is not shown, in order to be movable in a main scanning direction. The carriage 23 is moved by a main scanning motor which is not shown, via a timing belt stretched between a driving pulley and a driven pulley, to scan in the main scanning direction. The carriage 23 incorporates a recording head 24, which is formed of a liquid droplet discharging head for discharging liquid droplets in each of plural colors. The carriage 23 incorporating the recording head 24 functions as a shuttle type head unit. That is, while intermittently moving the carriage 23 in the main scanning direction and intermittently moving the paper 5 in a paper transfer direction (sub-scanning direction) by the sub-scanning transfer part 3, the liquid droplets are discharged from the recording head 24 onto the paper 5 to form an image.

The recording head 24 is formed of five liquid droplet discharging heads (hereinafter simply referred to as "heads), which include two heads to discharge black (Bk) ink, and three heads to discharge cyan (C) ink, magenta (M) ink, and yellow (Y) ink, respectively. Subtanks 25 of the respective colors, which are mounted on the carriage 23, supply inks to the corresponding heads.

As shown in FIG. 1, ink cartridges, serving as recording liquid cartridges storing black (K) ink; cyan (C) ink; magenta (M) ink; and yellow (Y) ink respectively, can be detachably mounted in a cartridge mounting part 26 from a front face of the apparatus body 1. The respective ink cartridges supply inks to the subtanks 25 of the corresponding colors. Note that the black ink is supplied from one ink cartridge to two subtanks 25 for the black ink.

As the recording head 24, the following types of recording heads can be used: a piezoelectric type recording head using piezoelectric elements as pressure generating units (actuators) to press ink in an ink channel (pressure generating chamber), which discharges ink droplets by changing the volume of the ink channel by deforming a vibrating plate serving as a wall surface of the ink channel by using the piezoelectric elements; a thermal type recording head which discharges ink droplets by pressure of bubbles generated by heating an ink in an ink channel by using a heating element; and an electrostatic type recording head having a vibrating plate serving as a wall surface of an ink channel and an electrode arranged to face each other, which discharges ink droplets by changing the volume of the ink channel by deforming the vibrating plate with an electrostatic force generated between the vibrating plate and the electrode; and the like.

The sub-scanning transfer part 3 includes a transfer belt 31 as an endless transfer belt, which functions to change the transfer direction of the paper 5 fed from below by approximately 90° to be transferred to face the image forming part 2. The transfer belt 31 is stretched between a transfer roller 32 serving as a driving roller and a driven roller 33 serving as a tension roller. The sub-scanning transfer part 3 further includes a charging roller 34 serving as a charging part, to which an AC high voltage is applied from a high voltage power source to charge a surface of the transfer belt 31. The sub-scanning transfer part 3 further includes a guiding member 35 which guides the transfer belt 31 in a region facing the image forming part 2; a pressing roller (pressure roller) 36 and a guiding plate 37 which function to press the paper 5 onto the transfer belt 31; a separating claw 38 for separating the paper 5 on which an image is formed by the image forming part 2 from the transfer belt 31; and transfer rollers 71*a* and 72*a* for sending the paper 5 separated from the transfer belt 31 to a paper output transfer part 7. A rotation amount measuring device 30 to measure an amount of rotation of the endless belt 31 is provided in the vicinity of the endless belt 31. The sub-scanning transfer part 3 of this image forming apparatus includes the transfer apparatus of the present invention. The transfer apparatus of the present invention is described in detail below.

The transfer belt 31 of the sub-scanning transfer part 3 is configured to rotate in the paper transfer direction when the transfer roller 32 is driven by a sub-scanning motor 27 via a timing belt and a timing roller, which are not shown. The transfer belt 31 has, for example, a two-layer structure formed of a front layer serving as a paper attaching surface, which is formed of a pure resin material which is not controlled in resistance, such as an ETFE (ethylene-tetrafluoroethylene) pure material; and a back layer (intermediate resistance layer, earth layer) which is formed of the same material as the front layer and is controlled in resistance by carbon. However, the structure of the transfer belt 31 is not limited to this and may have a structure formed of a single layer or multiple layers of three or more.

A cleaning unit (mylar (registered trademark) is used here) for removing paper dust and the like adhering on the surface of the transfer belt 31 and an anti-static brush for removing a charge on the surface of the transfer belt 31 are provided between the driven roller 33 and the charging roller 34.

The paper feed part 4 includes a paper feed cassette 41, which can be taken out and inserted in the apparatus body 1, that stores a large number of stacked sheets of the paper 5. The paper feed part 4 further includes a paper feed roller 42 and a friction pad 43 to pick up and send the paper 5 stored in the paper feed cassette 41 one by one, and a pair of paper feed transfer rollers 44 which transfers the fed paper 5 to the sub-scanning transfer part 3. The paper feed roller 42 is rotated by a paper feed motor (driving source) 49 formed of an HB type stepping motor via a paper feed clutch 48. Moreover, the paper feed transfer rollers 44 are driven by the paper feed motor 49 to be rotated. In addition, the paper feed part 4 includes a manual feed guiding plate 46; a single paper manual feed tray 141; and the like as paper feed devices.

The paper output transfer part 7 includes pairs of rollers 71*a* and 72*a*, 71*b* and 72*b*, and 71*c* and 72*c* (hereinafter collectively referred to as rollers 71 and 72), which transfer the paper 5 which has undergone image formation. The paper output transfer part 7 further includes a pair of inverting paper output transfer rollers 77 and a pair of paper output rollers 78, which send out the paper 5 to the paper output tray 8. The pair of paper output transfer rollers 71 and 72, the pair of inverting paper output rollers 77, and the pair of paper output rollers 78 are driven to be rotated by a paper output motor 79 (driving source) formed of an HB (hybrid) type stepping motor. In addition, the paper 5 can be output onto a straight paper output tray 181 via a straight paper output path 82.

In double side transfer parts 101*a* and 101*b*, double side relay rollers 92 and double side transfer rollers 93 are arranged on a downstream side of a pair of double side entrance rollers 91 along a transfer direction of the recording paper. These rollers are driven by a not shown double side motor to transfer the paper 5 on which an image is formed on one of the surfaces. The paper 5 on which an image is formed on one of the surfaces is turned in direction by a branching claw 60 and transferred from the double side entrance rollers 91 via a double side transfer path 90*c* to a double side transfer path 90*a*. Further, inverting rollers 95 are arranged in a double side transfer path 90*b*. The paper 5 transferred from the double side transfer path 90*c* is switched back by the inverting rollers 95 driven by a not shown inverting motor, and then a switching claw 96 is switched to transfer the paper 5 at least to a pair of double side outlet rollers 94. The inverted paper 5 is then transferred to the paper feed transfer rollers 44 which are described above.

(Transfer Apparatus)

Figure 2:
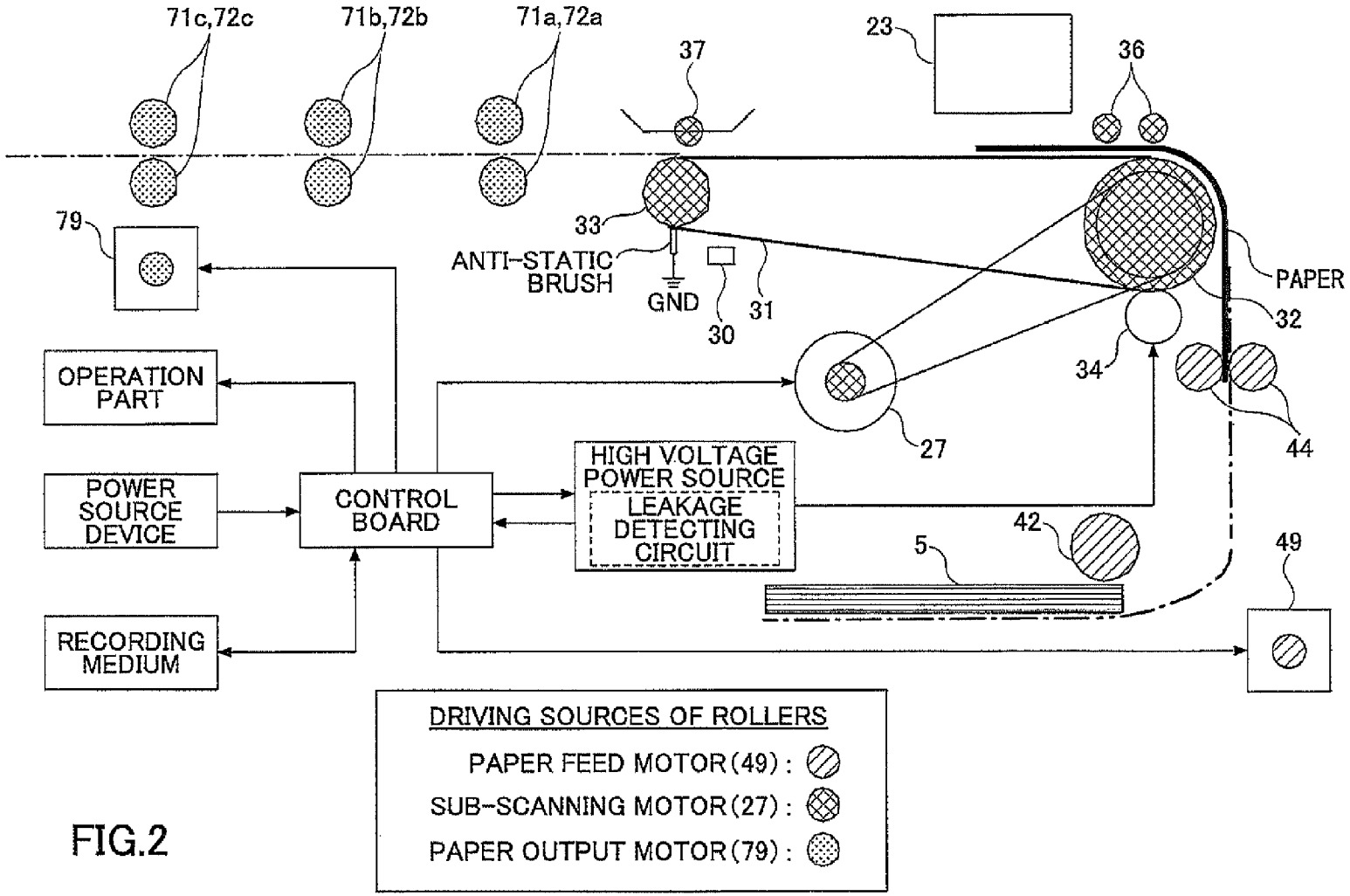
FIG. 2 is a schematic diagram showing paper held on a paper feed side of a transfer apparatus.

A transfer apparatus of the present invention is described with reference to FIG. 2. FIG. 2 is a diagram for describing the vicinity of the sub-scanning transfer part 3 shown in FIG. 1. In this embodiment, the sub-scanning transfer part 3 corresponds to the transfer apparatus of the present invention. In FIG. 2, a part of paper serving as a moisture absorbing member is held on a paper feed side of the transfer apparatus, which is the side of the transfer apparatus where a recording member starts to be transferred. A rear end part of the paper in a transfer direction of the paper is sandwiched by the pair of paper feed transfer rollers (roller pair) 44 in order not to be transferred further. The pair of paper feed transfer rollers 44 is configured to be capable of holding paper by energizing the paper feed motor 49. A part of the paper contacts the surface of the transfer belt 31. In this case, the part of the paper is made to securely contact the surface of the transfer belt 31 by the pressing rollers 36. The paper is not necessarily sandwiched and stopped by the pair of paper feed transfer rollers 44. Instead, the paper may be transferred at a slower speed than a transfer speed of the transfer belt 31. In this case, a part of the paper contacting the condensation on the transfer belt to absorb the moisture changes. Therefore, a whole surface of the paper can be used, and thus a moisture absorbing effect can be improved. As shown in FIG. 1, multiple rollers are provided as the paper feed transfer system of the image forming apparatus. Different rollers may be used as the rollers for holding the paper as long as the rollers can sandwich the paper and are driven by the paper feed motor. However, the rollers are required to be arranged at positions where the paper can contact the transfer belt 31.

In this transfer apparatus, the transfer belt 31 is driven by the transfer roller 32 and transfers the paper so that the paper passes a position facing the carriage 23. In this state, however, the paper is held by the paper feed transfer rollers 44. Therefore, since only the transfer belt 31 rotates counterclockwise, the paper and the transfer belt 31 slide relative to each other at a contact surface between them.

Here, when there is moisture of condensation and the like on the surface of the transfer belt 31, the paper absorbs the moisture at the contact surface with the transfer belt 31 to remove the moisture from the surface of the transfer belt 31. When the transfer belt 31 rotates once at a contact part with the paper, all the moisture on the surface of the transfer belt 31 is absorbed by the paper. As a result, there is no moisture on the surface of the transfer belt 31. An amount of rotation of the transfer belt 31 is measured by the rotation amount measuring device 30 arranged in the vicinity of the transfer belt 31. Even when a high voltage is applied to the transfer belt 31 on which no moisture exists, an abnormal leakage current is not caused to flow from the transfer belt 31. Therefore, the transfer apparatus becomes ready to start a normal operation. Then, the paper held by the paper transfer rollers 44 is released and the paper which has absorbed moisture is transferred to the paper output transfer rollers 71 and 72.

In order to determine whether the moisture has been removed from the transfer belt 31, a predetermined voltage is applied from the charging roller 34 to the transfer belt 31 and a leakage current caused at that time is detected by a leakage current detecting device. When the leakage current is not small enough, the voltage application is stopped and the operation to absorb the moisture on the surface of the transfer belt 31 by paper is performed again as described above, and the leakage current is measured. In that case, the paper to be held for absorbing the moisture may be replaced with new paper.

Figure 3:
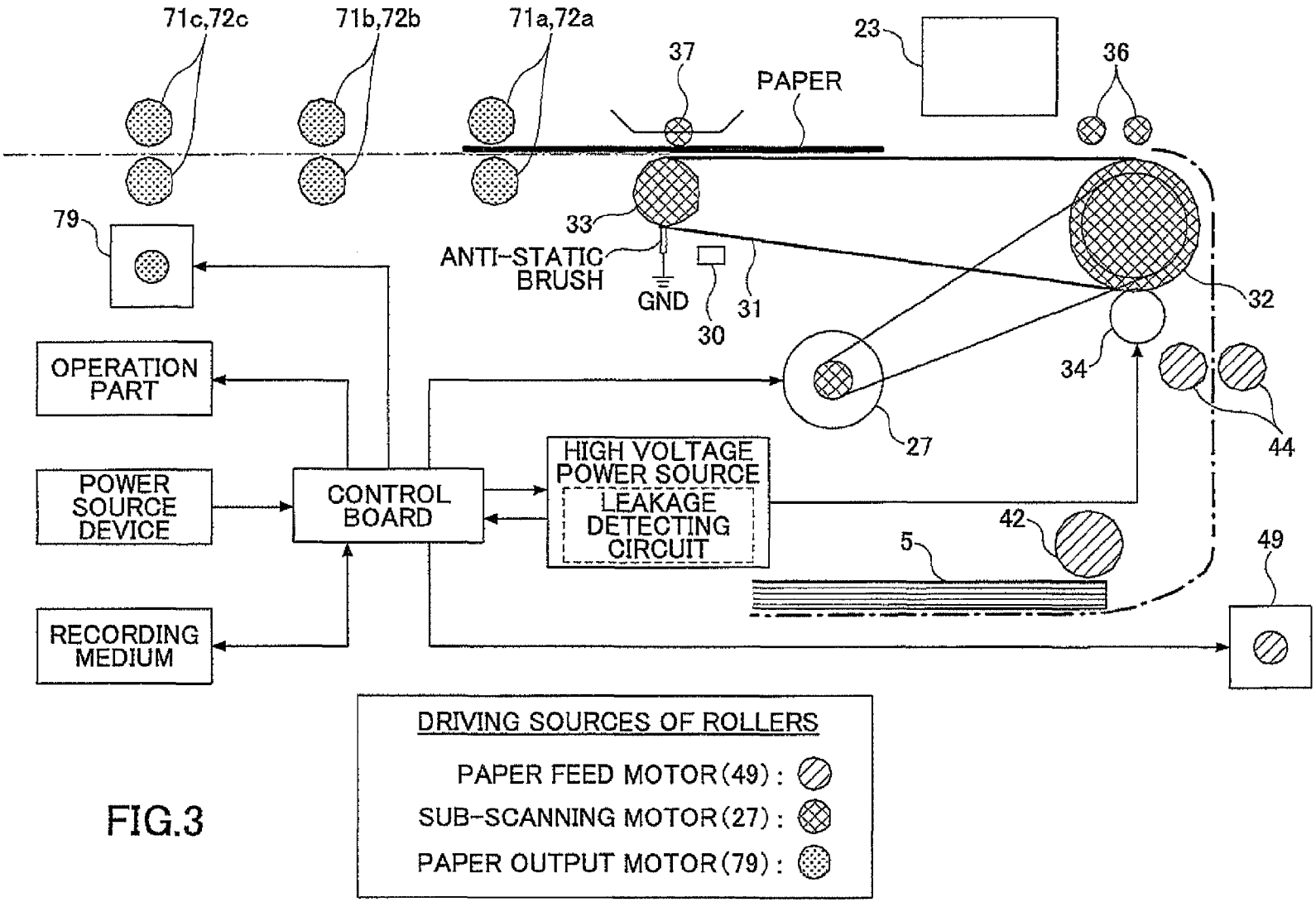
FIG. 3 is a schematic diagram showing paper held on a paper output side of the transfer apparatus.

FIG. 3 is a schematic diagram showing a holding position of the paper serving as the moisture absorbing member, which has changed from the transfer start position to a transfer end position of the transfer belt, where the transfer belt finishes transferring the recording member. In this case, the paper is sandwiched and held by the pair of paper output transfer rollers 71*a* and 72*a*. The paper is made to contact the surface of the transfer belt 31 by the guiding plate 37. When the paper is used for absorbing the moisture on the surface of the transfer belt 31, the transfer belt 31 is rotated clockwise, which is the reverse direction to that in the normal operation. Accordingly, the paper which is always receiving a tensile stress slides in contact with the transfer belt 31 without causing a wrinkle or bending. In this manner, the moisture on the surface of the transfer belt 31 is absorbed by the paper. Since other configurations and operations are the same as those described with reference to FIG. 2, descriptions of these are omitted here.

(First Method for Preventing Leakage Current of Transfer Apparatus)

Figure 4:
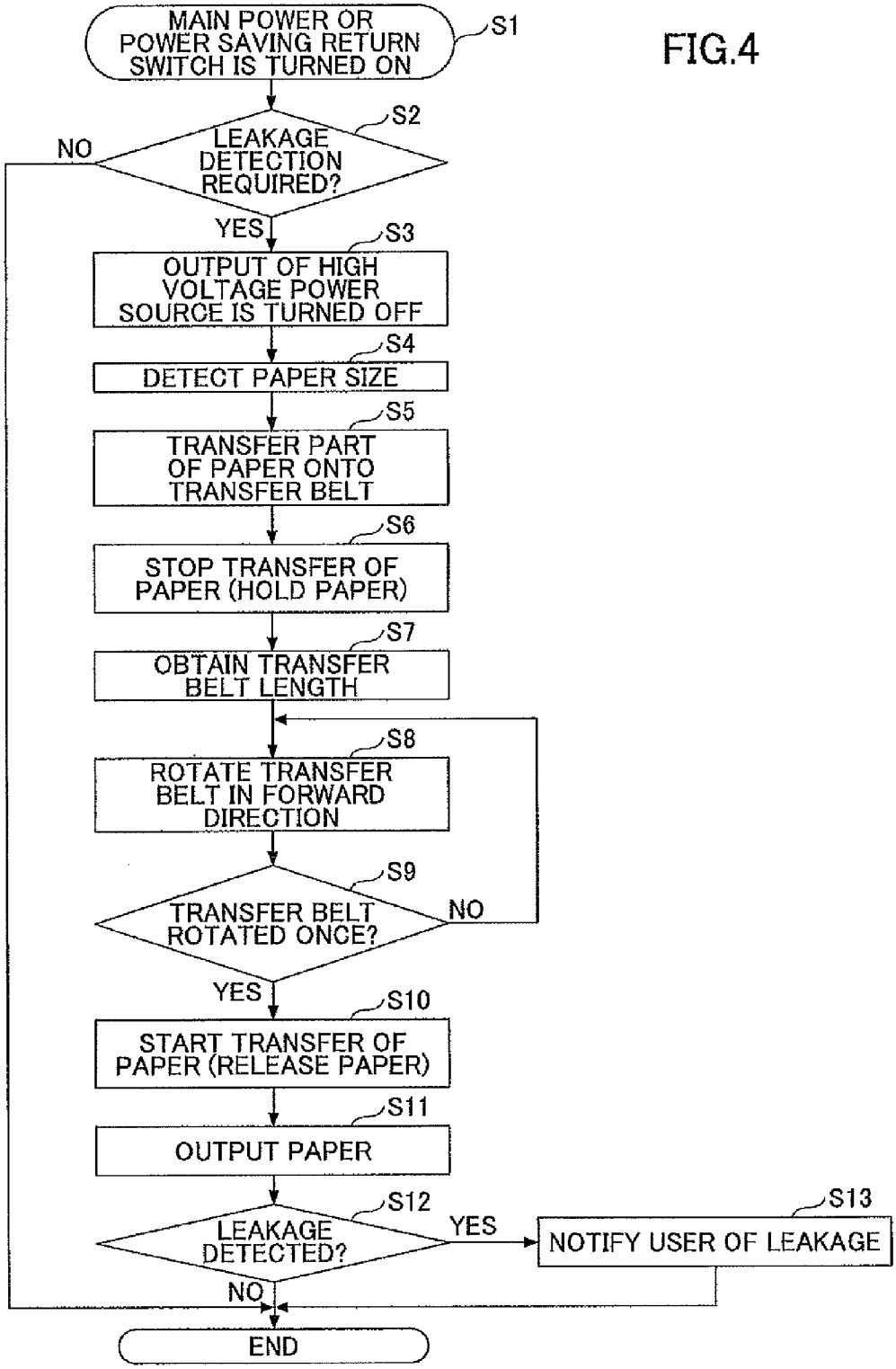
FIG. 4 is a flowchart of the first method for preventing a leakage current of a transfer belt.

FIG. 4 is an example of a flowchart showing a first method for preventing a leakage current of a transfer apparatus of the present invention. The flowchart of FIG. 4 corresponds to a method for preventing a leakage current from being caused in an image forming apparatus including the transfer apparatus of the present invention, which is shown in FIGS. 1 and 2. When the main power or a power saving return switch of the image forming apparatus is turned on, the method for preventing a leakage current of the transfer apparatus is performed as shown in FIG. 4.

When the main power or the power saving return switch is detected as being turned on (step S1), it is determined whether a leakage current detection is required (step S2). This step is performed to omit the leakage current detection in the case where it is known in advance that no condensation is formed on the transfer belt, such as the case where the power is turned on within a short time after the power is turned off. When the leakage current detection is determined to be required in step S2 (YES in S2), the high voltage power source applied from the charging roller 34 is turned off (step S3), and the size of the paper 5 provided in the paper feed part 4, which is used as the moisture absorbing member, is detected (step S4). The paper 5 is transferred onto the transfer belt 31 by the paper feed transfer rollers 44 and the like serving as a pre-transfer device (step S5). When a part of the paper 5 contacts the surface of the transfer belt 31 of the transfer apparatus, the driving of the paper feed transfer rollers 44 is stopped to sandwich the paper 5 by the pair of paper feed transfer rollers 44 in order not to be transferred further (step S6). At this time, it is preferable to sandwich the rearmost end of the paper 5 in the transfer direction by the paper feed transfer rollers 44. Accordingly, a contact area between the transfer belt and the paper 5 which is held becomes a maximum, and therefore, moisture on the surface of the transfer belt 31 can be reliably absorbed by the paper 5 as described below.

A transfer belt length which is recorded in advance is obtained (step S7) and at the same time the transfer belt 31 is rotated in a normal direction to transfer a recording member (hereinafter, the normal direction to transfer the recording member is referred to as a forward direction while an opposite direction is referred to as a reverse direction) (step S8). At this time, the paper 5 absorbs the moisture on the surface of the transfer belt 31 by sliding on the transfer belt 31. When the transfer belt 31 is rotated once (step S9), the holding of the paper by the paper feed transfer rollers 44 is released so that the paper starts to be transferred further (step S10). The paper 5 is transferred by the transfer belt 31 as it is and output from the transfer belt 31 to the paper output transfer rollers 71 and 72 (step S11).

A predetermined voltage is applied from the charging roller 34 to the transfer belt 31, and a leakage current caused at that time is detected (step S12). When the leakage current is abnormally large, a notification by a display, a lamp, a buzzer, and the like is made to an operator who is using the apparatus (step S13).

Normally, the method for preventing a leakage current of the transfer apparatus is completed by the operations as described above. In this case, one sheet of paper can absorb the condensation formed all around the transfer belt, and a leakage current can be prevented.

(Second Method for Preventing Leakage Current of Transfer Apparatus)

Figure 5:
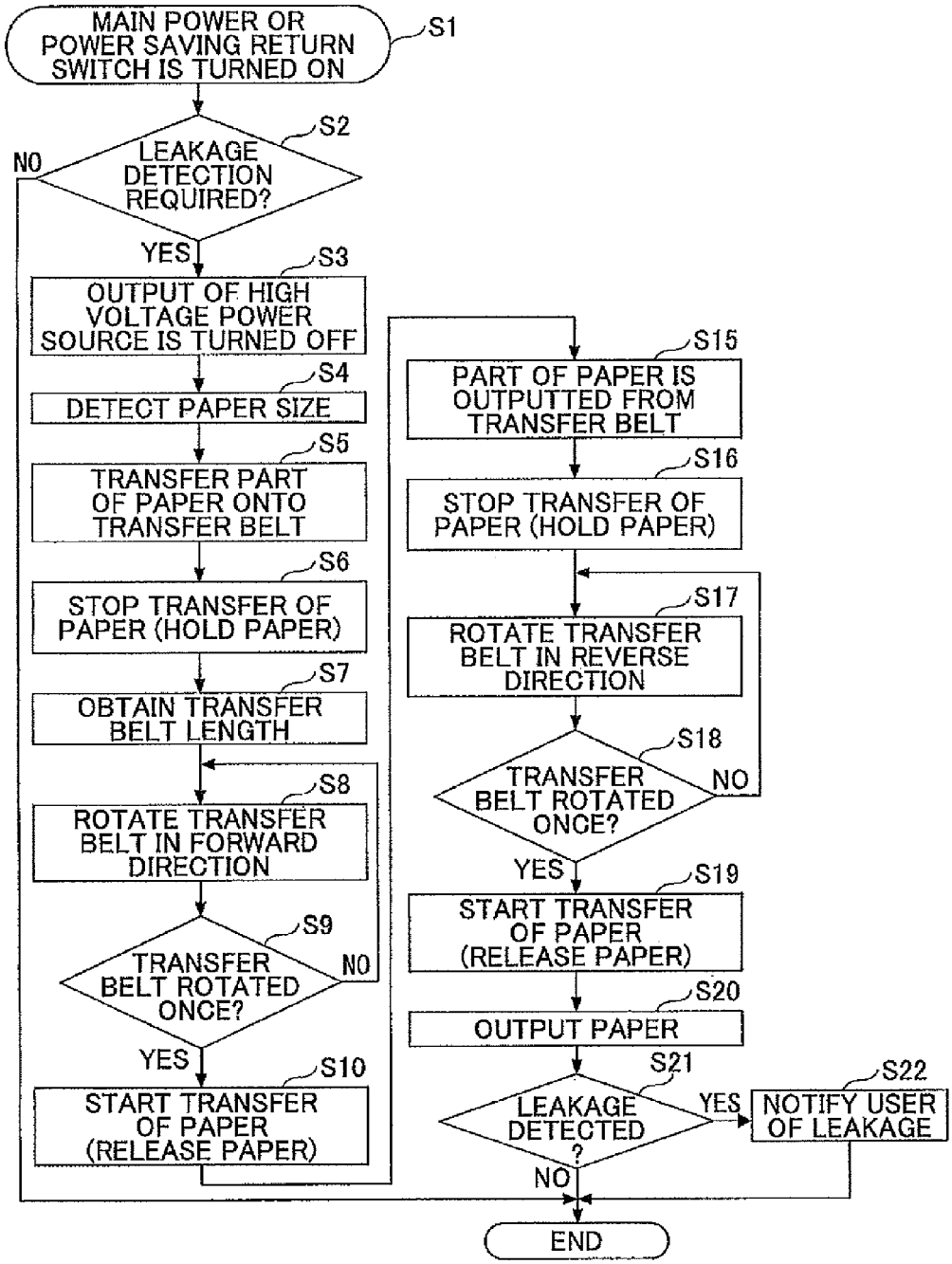
FIG. 5 is a flowchart of the second method for preventing a leakage current of a transfer belt.

By an example of a second method for preventing a leakage current of the transfer apparatus of the present invention, moisture is removed more completely than in the first method for preventing a leakage current of the transfer apparatus. FIG. 5 is a flowchart showing the second method for preventing a leakage current of a transfer apparatus of the present invention. In the second method for preventing a leakage current of the transfer apparatus, the same steps as the first method for preventing a leakage current of the transfer apparatus are employed for an operation to turn on the main power or the power saving return switch (step S1) to an operation to start transferring the paper (release the paper) (step S10).

In the second method for preventing a leakage current of the transfer apparatus, the paper 5 starts to be transferred (the paper is released) (step S10), the paper 5 is transferred on the transfer belt 31, and a part of the paper 5 is output from the transfer belt 31 (step S15). When the paper 5 reaches a space between the paper output transfer rollers 71*a* and 72*a*, the driving of the transfer belt 31 is stopped and the paper 5 is sandwiched and held by the paper output transfer rollers 71*a* and 72*a* (step S16). At this time, a rear end part of the paper 5 is on the transfer belt 31 and pressed by the guiding plate 37 to contact the surface of the transfer belt 31.

Here, the transfer belt 31 is rotated in the reverse direction (step S17). When one rotation of the transfer belt 31 is confirmed (step S18), the rotation of the transfer belt 31 is stopped and the paper 5 held by the paper output transfer rollers 71*a* and 72*a* is released. The transfer belt 31 and the paper output transfer rollers 71 and 72 are driven to transfer the paper 5 in the forward direction (step S19). Then, the paper 5 is completely output from the transfer apparatus (step S20).

A predetermined voltage is applied from the charging roller 34 to the transfer belt 31 and a leakage current caused at that time is detected (step S21). When the leakage current is abnormally large, a notification by a display, a lamp, a buzzer, and the like is made to an operator who is using the apparatus (step S22). Normally, the method for preventing a leakage current of the transfer apparatus is completed by the operations as described above. In this case, one sheet of paper is used twice for absorbing moisture. Therefore, the moisture can be more completely removed and the leakage current can be more reliably prevented than the first method for preventing a leakage current of the transfer apparatus. In particular, since both the front end part and rear end part of the paper can be used for moisture absorption, a larger amount of moisture can be absorbed.

(Transfer Apparatus Including Torque Detecting Device)

Figure 6:
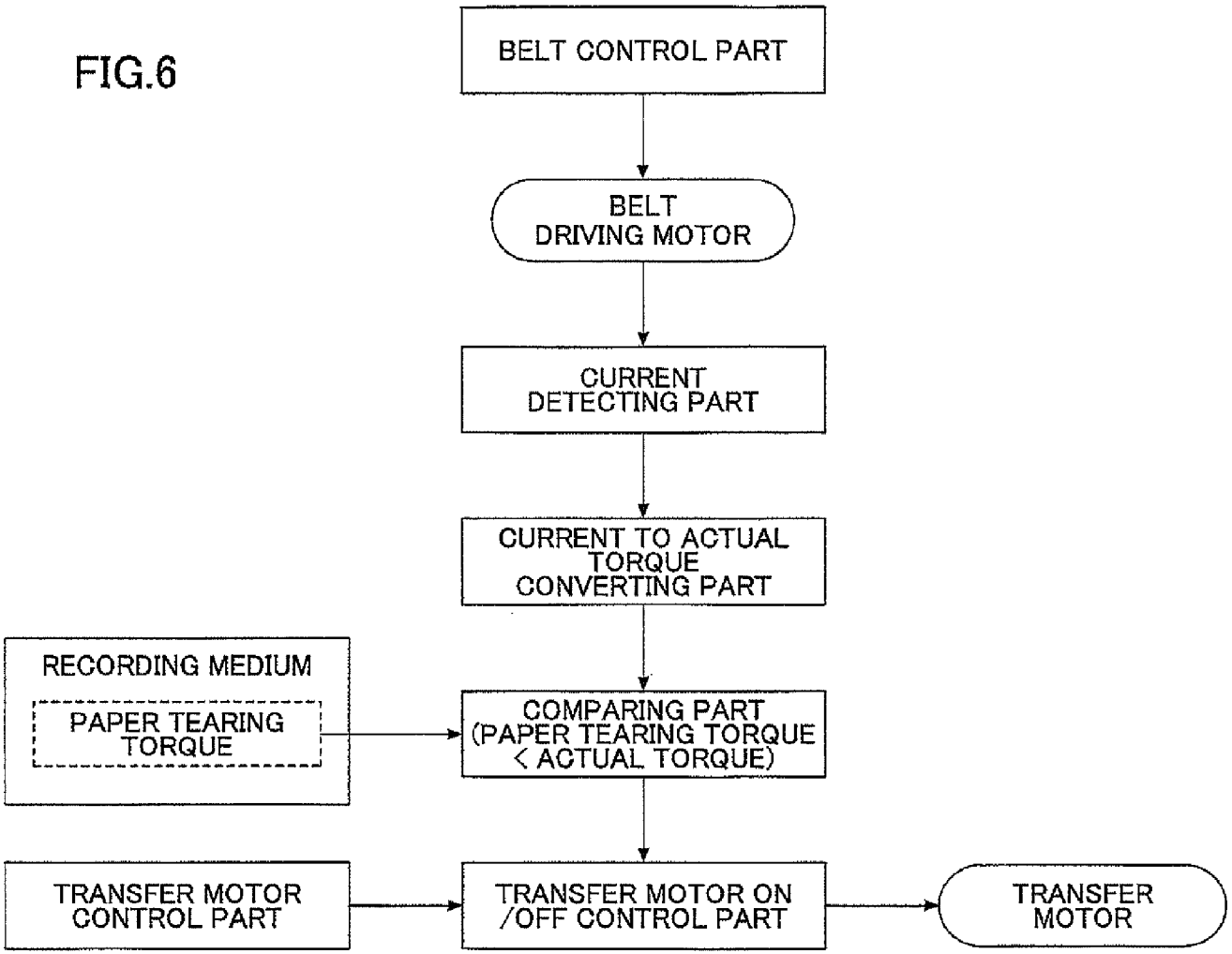
FIG. 6 is a block diagram showing an on/off control of a transfer motor of a holding device (paper holding device)

The transfer apparatus of the present invention may include a torque detecting device in the driving device of an endless belt. In the transfer apparatus of this mode, a problem caused by torn paper can be prevented in advance. The torque detecting device in the transfer apparatus of this mode and a control part to control a transfer motor to transfer the paper in accordance with the detected torque are shown in FIG. 6. FIG. 6 is a block diagram showing a control process of transfer motors 49 and 79 to drive devices for holding the paper, such as the paper feed transfer rollers 44 and the paper output transfer rollers 71 and 72 shown in FIGS. 1 and 2.

In FIG. 6, a belt control part of the transfer belt 31 detects a current value of the belt driving motor 27, converts the current value into an actual torque at which the transfer belt 31 is driven, and compares, in a comparing part, the actual torque with a torque at which paper is torn (a paper tearing torque) which is recorded in advance. While the actual torque is less than the paper tearing torque, the transfer motors 49 and 79 are stopped so that the paper is sandwiched and held by the paper feed transfer rollers 44 or the paper output transfer rollers 71 and 72. When the actual torque becomes equal to or greater than the paper tearing torque, an instruction is made from a transfer motor control part to drive the transfer motors 49 and 79 to move the paper with the transfer belt 31 to be output. Accordingly, the paper serving as the moisture absorbing member is output without being torn, causing no abnormality in the transfer apparatus.

(Third Method to Prevent Leakage Current of Transfer Apparatus)

Figure 7:
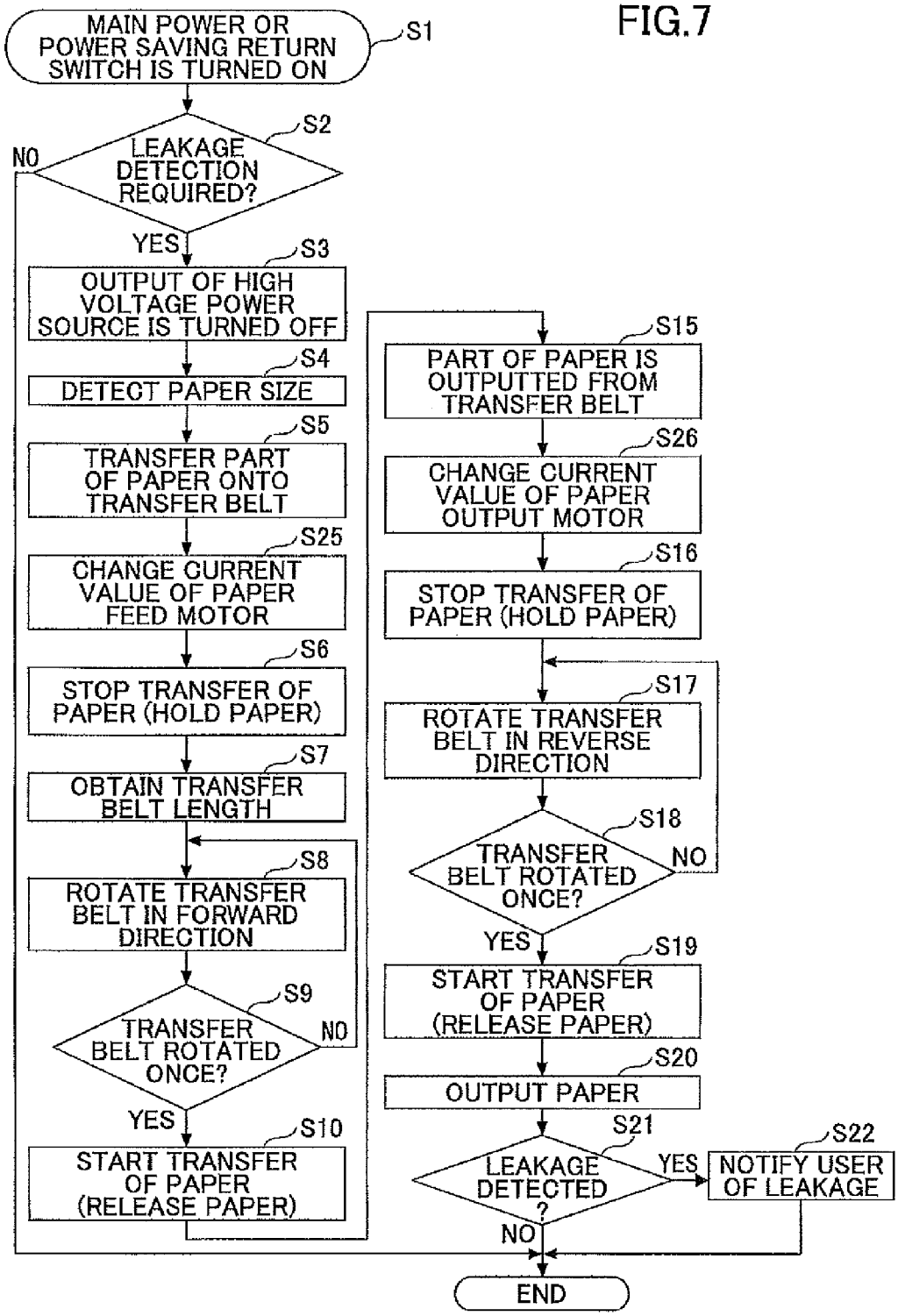
FIG. 7 is a flowchart of the third method for preventing a leakage current of a transfer belt.

An example of a third method for preventing a leakage current of a transfer apparatus of the present invention corresponds to the second method for preventing the leakage current of the transfer apparatus, with an improvement. FIG. 7 is a flowchart of the third method for preventing a leakage current of the transfer apparatus. In the third method for preventing a leakage current of the transfer apparatus, the same steps used for the second method for preventing a leakage current of the transfer apparatus are employed as basic steps of an operation to turn on the main power or the power saving return switch (step S1) to the last detection of a leakage current (step S21), and an operation to make a notification of a leakage current to a user (step S22).

The third method for preventing a leakage current is different from the second method for preventing a leakage current in that steps 25 and 26 are added. After a part of the paper is transferred onto the transfer belt 31 in step 5, a current value of the transfer motor 49 serving as the paper feed motor is set small so that a sandwiching and holding force of the paper feed transfer rollers 44 against the paper becomes smaller than a tearing strength of the paper which has absorbed moisture. This current value is preferably measured in advance and recorded in the transfer apparatus.

After the paper is sandwiched and held by the paper feed transfer rollers 44 (step S6), a part of the paper is output from the transfer belt 31 in step S15 in the same manner as for the second method for preventing a leakage current of the transfer apparatus. When the paper reaches the space between the paper output transfer rollers 71*a* and 72*a*, a current value of the paper output motor 79 is set small in step S26 so that a sandwiching and holding force of the paper output transfer rollers 71*a* and 72*b* against the paper becomes smaller than a tearing strength of the paper which has absorbed moisture. This current value is preferably measured in advance and recorded in the transfer apparatus. After the paper is sandwiched and held by the paper output transfer rollers 71*a* and 72*a* (step S16), the last detection of a leakage current is performed (step S21), and a notification of the leakage current to the user (step S22) is performed in the same manner as the second method for preventing a leakage current of the transfer apparatus, thereby the third method for preventing a leakage current is ended.

In this method for preventing a leakage current of the transfer apparatus, in the case where a load (torque) transmitted to the paper from the transfer belt 31 becomes equal to or greater than a stress at which the paper is torn when removing the condensation, the load exceeds the sandwiching force of the paper feed transfer rollers 44 and the paper output transfer rollers 71*a* and 72*a*. Therefore, the transfer motor steps out and the paper transfer rollers 44 and the paper output transfer rollers 71*a* and 72*a* cannot keep holding the paper. As a result, the paper is transferred by the transfer belt 31 without being torn. Since the transfer apparatus of this mode requires no torque detecting device, the configuration of the transfer apparatus can be simplified.

(Transfer Apparatus Including Marking Device)

Figure 8:
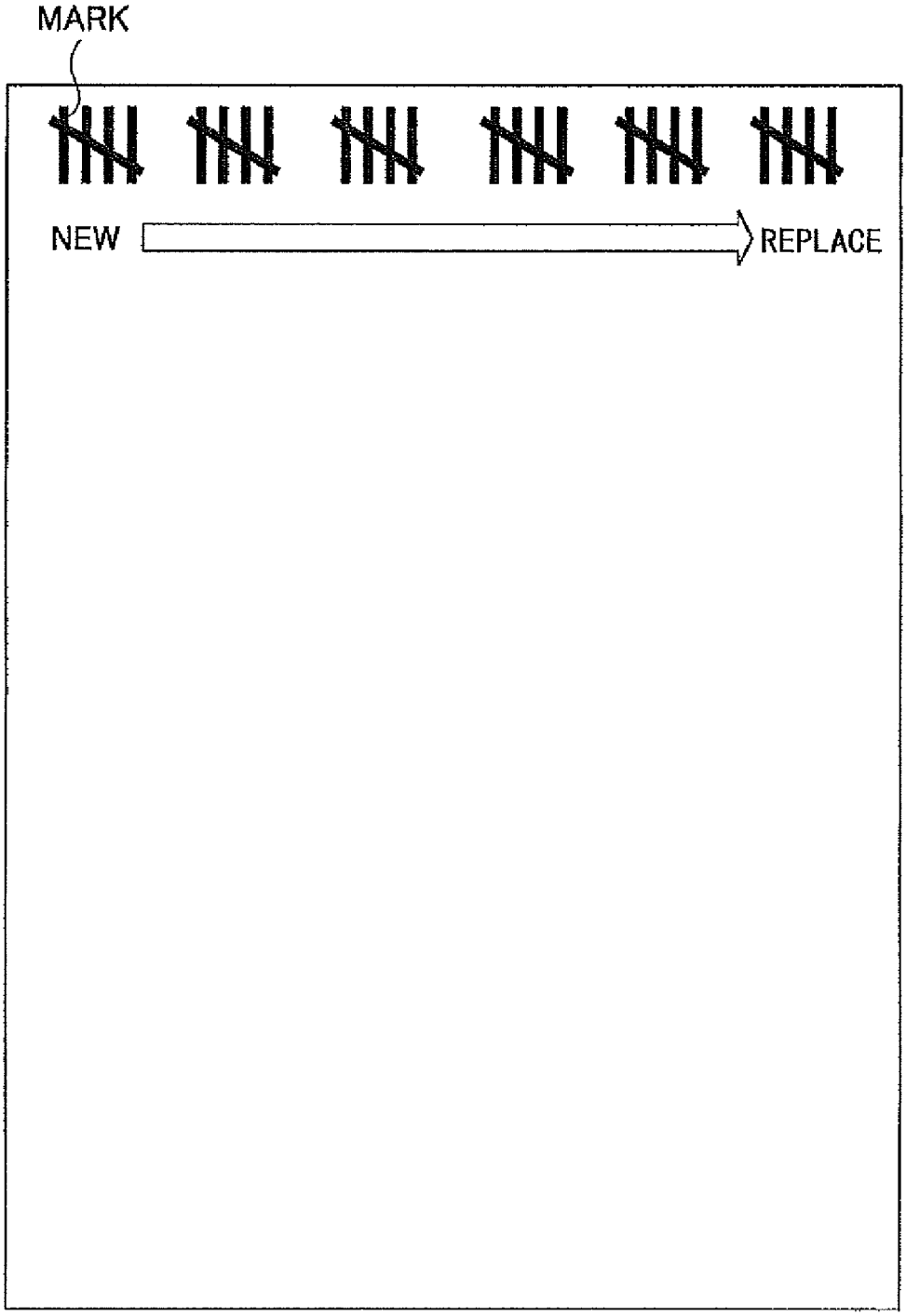
FIG. 8 is a diagram showing an example of marks made on paper used for moisture absorption.

A transfer apparatus of the present invention may include a marking device to mark the paper used as the moisture absorbing member. FIG. 8 shows an example of paper, a part of which has marks made when the paper is used as the moisture absorbing member. When the removal of condensation is performed once, one mark is made on the paper used for the removal of the condensation as shown in FIG. 8. In the example of FIG. 8, one line is marked on the paper for one operation to remove the condensation. Therefore, this paper indicates 30 times of usages for removing the condensation. The mark may be any pattern as long as the number of times that the paper has been used for absorbing moisture can be recognized.

When the same paper is used plural times for removing condensation, the paper is bent due to paper dust, a stain of ink and the like, and moisture absorption. In that case, the condensation may not be sufficiently removed. By marking the paper, the number of times that the paper has been used for removing the condensation can be visually recognized, and a timing to replace the paper can be easily known. Thus, a stable removal of condensation can be performed.

(Fourth Method for Preventing Leakage Current of Transfer Apparatus)

Figure 9:
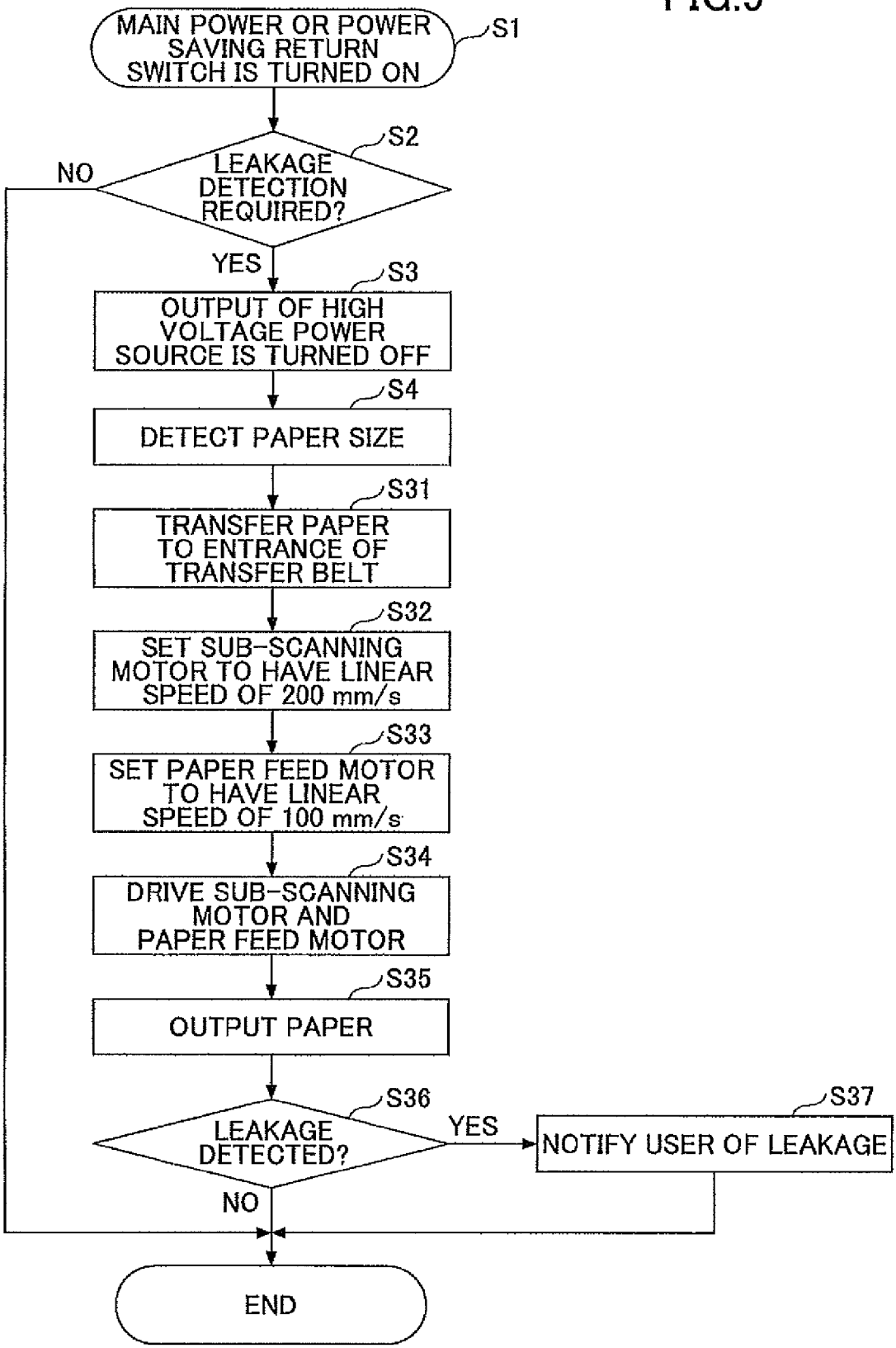
FIG. 9 is a flowchart of the fourth method for preventing a leakage current of a transfer belt.

An example of a fourth method for preventing a leakage current of the transfer apparatus of the present invention corresponds to the first method for preventing a leakage current of the transfer apparatus, which is improved so that a whole surface of paper can be used to absorb moisture without concentrating the moisture absorption onto a part of the paper. FIG. 9 is a flowchart of the fourth method for preventing a leakage current of the transfer apparatus. In the fourth method for preventing a leakage current of the transfer apparatus, the same steps as the first method for preventing a leakage current of the transfer apparatus are employed for an operation to turn on the main power or the power saving return switch (step S1) to an operation to detect a size of the paper (step S4).

In the fourth method for preventing a leakage current of the transfer apparatus, after the size of paper is detected (step S4), the paper is transferred to an entrance of the transfer belt, where the paper starts to be transferred by the transfer belt (step S31), and the sub-scanning motor 27 is controlled so that a rotation speed of the transfer belt 31 becomes a predetermined value (200 mm/s in this example) (step S32). On the other hand, the paper feed motor 49 is controlled so that a transfer speed at which the paper feed transfer rollers 44 transfer the paper becomes a predetermined value (100 mm/s in this example) which is lower than the predetermined value of the rotation speed of the transfer belt 31 (step S33). Then, the paper is transferred by driving the vertical scanning motor 27 and the paper feed motor 49 (step S34).

While the paper is sandwiched by the paper feed transfer rollers 44, the paper is transferred at the transfer speed of the paper transfer rollers 44. Meanwhile, since the transfer belt 31 moves at a higher speed than the transfer speed of the paper transfer rollers 44, the paper slides on the transfer belt 31, absorbing condensation on the transfer belt 31. When the rear end of the paper reaches the transfer belt 31, the paper is transferred via the transfer belt 31 as it is and output to the paper output transfer rollers 71 and 72 (step S35).

A predetermined voltage is applied from the charging roller 34, and a leakage current caused at that time is detected (step S36). When the leakage current is abnormally large, a notification is made by a display, a lamp, a buzzer, and the like to an operator who is using the apparatus (step S37). Since one sheet of paper may not be enough to absorb the moisture generated all around the transfer belt 31, the operation as described above is normally repeated plural times to end the method for preventing a leakage current of the transfer apparatus. In this case, the condensation formed all around the transfer belt can be absorbed by using plural sheets of paper and a leakage current can be prevented.

When there is a greater difference between the set values of the rotation speed of the transfer belt 31 and the transfer speed of paper by the paper feed transfer rollers 44, a lesser number of paper sheets are required for moisture absorption. In the case where there is so much condensation on the transfer belt 31, however, the moisture sometimes cannot be absorbed by the paper when the paper has absorbed moisture to the limit of its moisture absorbing ability. Normally, it is preferable that the difference between the rotation speed of the transfer belt 31 and the transfer speed of the paper feed transfer rollers 44 be set so that one sheet of paper contacts the whole surface of the transfer belt 31 in one rotation. As a result, one sheet of paper can absorb the condensation existing all around the transfer belt 31 by using the whole surface of the paper.

Figure 10:
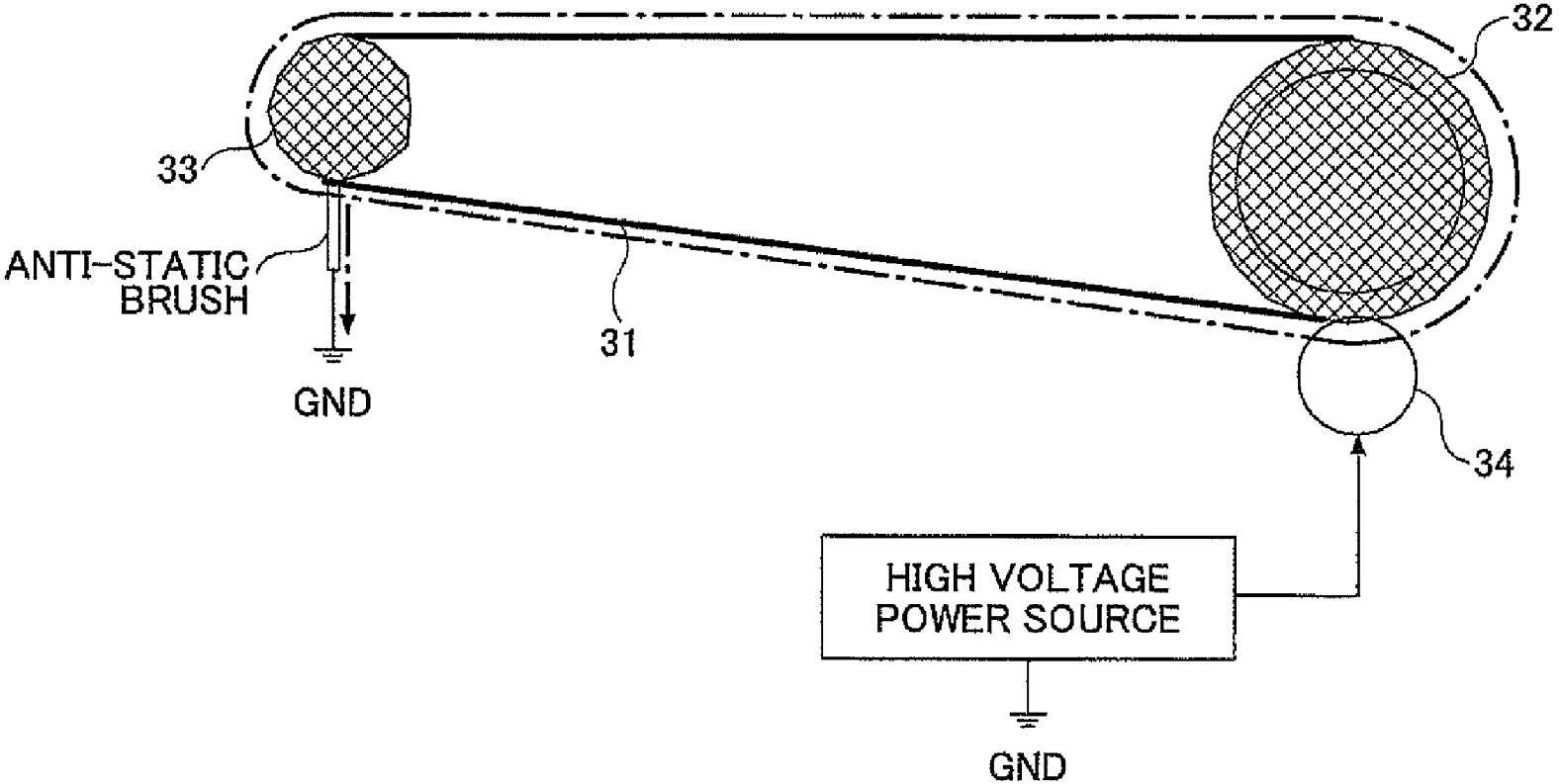
FIG. 10 is a diagram illustrating a mechanism of a leakage current generated from the transfer belt due to condensation.

A mechanism of a leakage current generated from the transfer belt due to condensation is described with reference to FIG. 10. In FIG. 10, a high voltage is applied from the charging roller 34 to the transfer belt 31 in the transfer apparatus, and the anti-static brush is used to eliminate the charge. When the transfer belt 31 is dried without condensation, the anti-static brush eliminates the charge of only a part of the surface of the transfer belt 31 which has finished transferring the paper. However, when the transfer belt 31 has a wet surface or a water layer is formed on the surface of the transfer belt 31 due to condensation, the surface resistance of the transfer belt 31 becomes small. Thus, charges of other parts of the transfer belt 31, which are not supposed to be eliminated, are eliminated. In a worst case, charges all around the transfer belt 31 are eliminated. That is, the current leaks to the anti-static brush through the condensation on the surface of the transfer belt. This phenomenon is called the generation of an abnormal leakage current. When the abnormal leakage current is generated, a problem occurs in the high voltage power source device of the transfer apparatus, which causes other control systems to generate an abnormal current or causes a possibility of electric shock. Therefore, normally, when an abnormal leakage current is detected by the high voltage power source device, power of the high voltage power source device or the whole image forming apparatus is turned off as an apparatus error.

The transfer apparatus and the method for preventing a leakage current of the transfer apparatus of the present invention can be favorably applied to an inkjet type image forming apparatus; however, the present invention is not limited to this. The transfer apparatus and the method for preventing a leakage current of the transfer apparatus of the present invention can be applied to other image forming apparatuses and an apparatus having a transfer apparatus, which may cause a problem due to condensation generated in the transfer apparatus. Further, the image forming apparatus of the present invention is not limited to being applied to a simple image forming apparatus (inkjet printer), and can be favorably applied to a copying apparatus as described above, a facsimile apparatus, a printing apparatus, a multifunction peripheral having the functions of these apparatuses, and the like.

According to one embodiment, a transfer apparatus, a method for preventing a leakage current of the transfer apparatus, and an image forming apparatus including the transfer apparatus can be provided, by which recording paper sheets wasted for absorbing condensation are drastically reduced, and a leakage current due to condensation on the transfer belt is resolved without significantly increasing the manufacturing cost and power consumption.

This patent application is based on Japanese Priority Patent Application No. 2008-109514 filed on Apr. 18, 2008, and Japanese Priority Patent Application No. 2009-046561 filed on Feb. 27, 2009, the entire contents of which are hereby incorporated herein by reference.

What is claimed is:

1. A transfer apparatus comprising:

an endless belt configured to transfer a recording member by attaching the recording member on a surface thereof by an electrostatic force;

a driving device configured to rotate the endless belt; and a holding device configured to temporarily hold the recording member to hinder a movement thereof caused by a movement of the endless belt rotated by the driving device so that a part of the recording member slides on the surface of the endless belt, wherein the holding device also functions as a pair of transfer rollers configured to sandwich and transfer the recording member to a transfer start position on the endless belt, where the recording member starts to be transferred; and the transfer rollers hold the recording member at the transfer start position.

2. The transfer apparatus as claimed in claim 1, wherein the driving device includes a torque detecting device configured to detect a driving torque of the endless belt when the holding device is holding the recording member.

3. The transfer apparatus as claimed in claim 2, wherein the holding device releases the recording member when the torque detecting device detects the driving torque being equal to or greater than a predetermined value.

4. The transfer apparatus as claimed in claim 1, further comprising a pre-transfer device configured to transfer the recording member to the transfer start position.

5. The transfer apparatus as claimed in claim 4, wherein the pre-transfer device transfers the recording member at a transfer speed slower than a transfer speed of the endless belt, so that the recording member slides on the surface of the endless belt.

6. The transfer apparatus as claimed in claim 1, further comprising a current detecting device configured to detect a leakage current from the endless belt.

7. The transfer apparatus as claimed in claim 6, wherein the current detecting device includes a leakage current notifying device configured to make a notification of the leakage current from the endless belt.

8. An inkjet image forming apparatus comprising the transfer apparatus as claimed in claim 1, wherein an image is formed by discharging ink on a recording member which is attached and transferred on the surface of the endless belt.

9. A transfer apparatus, comprising:

an endless belt configured to transfer a recording member by attaching the recording member on a surface thereof by an electrostatic force;

a driving device configured to rotate the endless belt; and a holding device configured to temporarily hold the recording member to hinder a movement thereof caused by a movement of the endless belt rotated by the driving device so that a part of the recording member slides on the surface of the endless belt, wherein the holding device holds the recording member at a transfer end position where the endless belt finishes transferring the recording member.

10. The transfer apparatus as claimed in claim 9, wherein the endless belt is configured to rotate in a direction reverse to a direction in which the recording member is transferred, while the recording member is held by the holding device at the transfer end position.

11. The transfer apparatus as claimed in claim 10, further comprising a post-transfer device configured to transfer the recording member from the transfer end position.

12. The transfer apparatus as claimed in claim 9, further comprising a post-transfer device configured to transfer the recording member from the transfer end position.

13. An inkjet image forming apparatus comprising the transfer apparatus as claimed in claim 9, wherein an image is formed by discharging ink on a recording member which is attached and transferred on the surface of the endless belt.

14. A transfer apparatus, comprising:

an endless belt configured to transfer a recording member by attaching the recording member on a surface thereof by an electrostatic forces;

a driving device configured to rotate the endless belt;

a holding device configured to temporarily hold the recording member to hinder a movement thereof caused by a movement of the endless belt rotated by the driving device so that a part of the recording member slides on the surface of the endless belt; and a marking device configured to mark the recording member when the holding device holds the recording member.

15. An inkjet image forming apparatus comprising the transfer apparatus as claimed in claim 14, wherein an image is formed by discharging ink on a recording member which is attached and transferred on the surface of the endless belt.

16. A method for preventing a leakage current of a transfer apparatus including an endless belt configured to transfer a recording member by attaching the recording member on a surface thereof by an electrostatic force; and a driving device configured to rotate the endless belt, the method comprising the steps of:

holding the recording member by a holding device to hinder a movement of the recording member caused by a movement of the endless belt rotated by the driving device such that a part of the recording member contacts the surface of the endless belt;

rotating the endless belt by the driving device so that the part of the recording member slides on the surface of the endless belt; and releasing the recording member to be transferred out of the endless belt, wherein the holding device also functions as a pair of transfer rollers configured to sandwich and transfer the recording member to a transfer start position on the endless belt, where the recording member starts to be transferred; and the transfer rollers hold the recording member at the transfer start position.

* * * * *